US006536588B1

(12) United States Patent
Kyrwood

(10) Patent No.: US 6,536,588 B1
(45) Date of Patent: Mar. 25, 2003

(54) GOLF CLUB SUPPORT

(76) Inventor: William Stephen Kyrwood, 89 Brighton Avenue, Toronto (AU)

( * ) Notice: Subject to any disclaimer, the term of this patent is extended or adjusted under 35 U.S.C. 154(b) by 0 days.

(21) Appl. No.: 09/936,096

(22) PCT Filed: Mar. 10, 2000

(86) PCT No.: PCT/AU00/00161

§ 371 (c)(1),
(2), (4) Date: Sep. 7, 2001

(87) PCT Pub. No.: WO00/54853

PCT Pub. Date: Sep. 21, 2000

(30) Foreign Application Priority Data

Mar. 12, 1999 (AU) ..... PP9140

(51) Int. Cl.[7] ..... A63B 55/00

(52) U.S. Cl. ..... 206/315.6; 206/315.2; 211/70.2

(58) Field of Search ..... 211/70.2; 206/315.2, 206/315.3, 315.6

(56) References Cited

U.S. PATENT DOCUMENTS

| | | | | | |
|---|---|---|---|---|---|
| 2,436,687 | A | | 2/1948 | Corbett | |
| 2,753,189 | A | * | 7/1956 | Conroy et al. | 211/70.2 |
| 3,503,518 | A | | 3/1970 | Black | |
| 3,534,795 | A | | 10/1970 | Wiedenmeier | |
| 4,055,207 | A | | 10/1977 | Goodwin | |
| 4,194,547 | A | * | 3/1980 | Sidor et al. | 206/315.6 |
| 4,200,131 | A | | 4/1980 | Chitwood et al. | |
| 4,208,227 | A | | 6/1980 | Cowan | |
| 4,340,102 | A | | 7/1982 | Isabel | |
| D293,852 | S | | 1/1988 | Scroggins | |
| 4,960,212 | A | | 10/1990 | Wu | |
| 5,029,703 | A | | 7/1991 | Dulyea, Sr. | |
| 5,135,107 | A | * | 8/1992 | Ingraham | 206/315.6 |
| 5,228,566 | A | | 7/1993 | Shenoha | |
| 5,238,109 | A | | 8/1993 | Smith | |
| 5,267,660 | A | | 12/1993 | Kwon | |
| 5,279,414 | A | | 1/1994 | Brasher | |
| D361,207 | S | | 8/1995 | Meyer | |
| 5,511,660 | A | * | 4/1996 | Yamada et al. | 206/315.6 |
| 5,617,951 | A | * | 4/1997 | Wick | 206/315.6 |
| 5,620,091 | A | * | 4/1997 | Larson | 206/315.6 |
| D384,503 | S | | 10/1997 | Kyrwood | |
| 5,755,332 | A | | 5/1998 | Holliday et al. | |
| 5,779,043 | A | * | 7/1998 | Hsu et al. | 206/315.6 |
| 5,803,252 | A | * | 9/1998 | Huo-Chuan | 206/315.6 |
| 5,964,346 | A | * | 10/1999 | O'Connor | 206/315.6 |
| 6,145,660 | A | * | 11/2000 | Chou | 206/315.3 |
| 6,202,841 | B1 | * | 3/2001 | Kang | 206/315.6 |

FOREIGN PATENT DOCUMENTS

| | | |
|---|---|---|
| AU | S-122985 | 3/1995 |
| AU | 704574 | 8/1995 |
| GB | 2326 105 A | 12/1998 |

* cited by examiner

*Primary Examiner*—Sue A. Weaver
(74) *Attorney, Agent, or Firm*—D. Peter Hochberg; Katherine R. Vieyra; Sean Mellino

(57) ABSTRACT

A golf club supporting device (10), where each club (18) comprises a shaft (21) and a head (19). The support (10) includes a base member (13) and a plurality of dividers (16) that extend outwardly from the base member (13). At least one divider (16) has a concave face (22) and an adjacent divider (16) has a generally oppositely facing convex face (23). The dividers (16) are positioned so as to define therebetween a space (17) for receiving a club head (19).

31 Claims, 4 Drawing Sheets

GOLF CLUB SUPPORT

FIELD OF THE INVENTION

The present invention relates to a device for supporting golf clubs and in particular to a device for holding golf clubs in a desired position when the clubs are stored in a golf bag.

BACKGROUND ART

To appropriately play the game of golf, it is well known that a player must normally have available a number of different clubs with each club used for playing different types of shots. One type of well known club is the playing iron. A set of irons will normally comprise a number of clubs of varying head angle with each club numbered in order of increasing head angle to allow for easy identification of the club by the player.

Golf clubs are normally carried in a golf bag. Most golf bags are generally of some tubular design and are carried by the player, placed on a buggy and pulled or pushed by the player, or attached to a golf buggy that is normally electrically powered and driven around the golf course. In most golf bags one or two partitions are normally provided adjacent the mouth of the bag to provide some support for the clubs. The partitions do not, however, prevent the clubs impacting one another and potentially damaging either the heads or shafts of the clubs as the bag or individual clubs are moved. The partitions also do not provide any means for orderly storing the clubs in a bag or prevent the clubs falling from the bag if it is laid down on its long side.

A number of devices have been proposed for holding the clubs in place in a golf bag. The devices tend to be one of two main types. The first type comprises a plate member that tends to cover all or the majority of the mouth of the bag. The plate normally has a number of orifices through which the handle and shaft of a club may be slid so that the club head rests on, in or near the plate member. Examples of this type of club holder are described in U.S. Pat. No. 4,055,207, U.S. Pat. No. 4,200,131, U.S. Pat. No. 4,340,102 and U.S. 5,228,566.

The second type of holder normally comprises an array of slots or notches into each of which the head of a club can be placed. Normally, sufficient slots are provided for at least an average set of playing irons. The slots can also be adapted so as to direct the player to place the right club head in the right slot and so provide some order to the storage of the clubs in the golf bag. Examples of this type of holder are described in U.S. Pat. No. 2,436,687, U.S. Pat. No. 4,208, 227, U.S. Pat. No. 4,960,212 and WO 95/20999.

The present invention is directed to an alternative holder for golf clubs.

SUMMARY OF THE INVENTION

According to a first aspect, the present invention comprises a device for supporting golf clubs, where each club comprises a shaft and a head, the device including a base member and a plurality of dividers extending outwardly from the base member, at least one divider having a concave face and an adjacent divider having a generally oppositely facing convex face, the dividers being positioned so as to define therebetween a space for receiving a club head.

The combination of the concave face and adjacent convex face serves to provide a cleating arrangement for the club head, with the club head held by relative small portions of the concave and convex faces.

In a preferred embodiment, each of the dividers has a first concave face and a generally opposite facing second convex face, such that the space defined between each pair of dividers of the device is defined by a concave and convex face.

Each space defined by a pair of dividers can be adapted to accommodate a specific club type. For example, each space can be adapted to accommodate a club having a specific club head of a particular loft angle. The base member preferably has a sufficient number of dividers to provide a number of spaces suitable for a typical set of golfing irons. In one particular embodiment, the base member has ten dividers defining in total nine club head spaces.

In one embodiment the dividers can be longitudinally aligned so as to form a rack for supporting the club heads. In one embodiment, the device can be integrally formed with or moulded to a golf bag.

In another embodiment, the base member can be mounted to the golf bag. In this second embodiment, the base member can have at least two leg members that are attachable to a golf bag. In a preferred embodiment, one leg can extend in a direction generally opposite to that of the outwardly extending dividers from a position at or adjacent a first end of the base member. Preferably, a second leg can extend in a direction generally opposite to that of the outwardly extending dividers from a position at or adjacent a second end of the base member. In one embodiment, these legs can be adjustable in length or position relative to the base member. At or adjacent the ends of the leg members distal the base member, the leg members are preferably provided with attaching means such that the leg members can be attached to a golf bag or other structure. The attaching means for each leg can comprise a clamp or pincer but other attaching means can be readily envisaged. In use, the leg members are preferably attached to the golf bag such that the base member is disposed above but relatively near the mouth of the bag. Other positions for the base member relative to the mouth of the bag can again also be readily envisaged.

The leg member at or adjacent the first end of the base member is preferably shorter than the leg member at the second end of the base member such that the base member is disposed at an angle to a notional plane normal to the longitudinal axis of the golf bag. This is advantageous as different golf clubs do come in different lengths, with the smaller the loft angle of the club head face, typically the longer the shaft of the club. While one of the spaces between the dividers must be at a height to accommodate the club having the longest shaft, it is not necessary for the remaining club heads to be positioned so distal the mouth of the golf bag. By setting the base member at an angle to the mouth of the bag, the centre of gravity of a set of club heads, when in an upright orientation. once placed in the bag is lowered compared to an arrangement where each of the heads are at all equal distance from the mouth of the bag. By providing legs of different lengths such that the base member is angled to the bag mouth, the length of the base member can be greater than if the base member was substantially parallel to the plane of the bag mouth. This increase in length allows the device to accommodate more clubs than if it was not the case.

In addition to the leas as defined above the base member can have a third leg disposed approximately midway between the first and second legs. This third leg also preferably has an attaching means distal the base member to allow attachment of the leg to the rim of the mouth of a golf bag. The third leg can be adjustable in length or position so as to allow the base member to be attached to bag mouths of varying shapes and dimensions.

In an alternative embodiment, the dividers can be disposed on an annular base member. In this embodiment, the base member can have a lower surface adapted to engage directly or indirectly with the rim of the mouth of the golf bag.

Each divider can be formed integrally with the base member or can be formed separately and then later attached to the base member in a suitable manner. The dimensions of each divider preferably decrease in both width and thickness away from an end integral with or attached to the base member to an end distal the base member. If a divider is viewed in end elevational view the divider decreases in width towards the distal end with the sides of the divider being preferably continuously curved with the curvature in one embodiment substantially parabolic. In side elevational view, the thickness of the divider also decreases towards the distal end, with the decrease preferably being smoothly tapering from the base member to the distal end.

The distance of each divider between the base member and the distal end of the divider can be between 40 and 50mm, and is more preferably about 45 mm. The width of each divider again where it joins the base member can be between about 40 and 60 mm, and is more preferably about 50 mm.

In a preferred embodiment of the device, the distance of separation between each pair of dividers measured where the dividers meet the base member (ie the distance between the convex face of one divider and the adjacent concave face of another divider where the dividers meet the base member) is substantially similar and more preferably the same. The measured distance between the dividers where they meet the base member can lie in the range 0 to 20 mm more preferably 1 to 6 mm, and most preferably is about 2 mm. The distance between each pair of convex faces can lie in the range 20 to 30 mm, and is more preferably about 24 mm.

With the device mounted to the mouth of the bag, the base member is preferably at an angle of between 10 and 40 degrees, more preferably between 20 and 30 degrees, and most preferable about 25 degrees to a notional plane normal to the longitudinal axis of the bag. The measured angle between the longitudinal axis of the convex face and true vertical, when the device is placed on a bag at an angle of about 25 degrees to the notional plane perpendicular to the longitudinal axis of the bag. preferably varies from the first end of the base member to its second end. In a preferred embodiment when mounted on the device, the angle between the convex face and true vertical preferably decreases from the first end to the second end. In the embodiment where ten dividers are provided in the device, the angle to vertical of the first to tenth convex faces can be as follows:

| Convex Face | Angle (degrees) |
|---|---|
| First | 16 |
| Second | 18 |
| Third | 21 |
| Fourth | 24 |
| Fifth | 28 |
| Sixth | 32 |
| Seventh | 36 |
| Eighth | 40 |
| Ninth | 44 |
| Tenth | 48 |

The angle of the convex face of a particular divider can be less than the loft angle of the club that would be expected to be stored in the space such that the ball-striking face of the club head contacts that convex surface. This is advantageous as the club head is placed in the device it causes a slight deflection of the divider which serves to increase the frictional engagement between the head and the dividers into which it has been brought into contact.

Each divider can be moulded from a suitable polymeric or elastomeric material. In a preferred embodiment, the dividers are formed from a resiliently flexible material. A natural or synthetic rubber a polyurethane or polyvinyl chloride are materials that could be used in the present invention. It is also envisaged that the concave and convex faces could be covered at least in part by a plurality of nodules that serve to increase the frictional engagement of the faces with the club head.

In use, the angle of the convex face of the divider and the curvature of the convex face result in this face preferably contacting the ball-striking surface of a club that is placed in the space adjacent the convex face. Preferably, contact is made between the ball-striking surface of the club and the convex face at least one location on the convex face. The one location is preferably adjacent the centre of the convex face approximately equidistant from the respective side walls of the divider. When placed in the space, the rear surface of the club head adjacent the bottom edge of the club also preferably contacts the surface of the concave face of the adjacent divider in two locations, namely adjacent the respective side edges of that divider. The engagement of the head of the club at these at least three locations serves to effectively grip the head of the club that is placed in the space.

According to a second aspect, the present invention comprises a device for supporting golf clubs, where each club comprises a shaft and a head having a front and rear face, the device including a base member, a plurality of dividers extending outwardly from the base member, each of the base members having a first face and a second generally oppositely facing second face, the dividers being positioned so as to define therebetween a space for receiving a club head, the first face being adapted to engage the rear face of the club at two locations and the second face being adapted to engage the front face of the club at one location.

BRIEF DESCRIPTION OF THE DRAWINGS

By way of example only, preferred modes of carrying out the invention are now described with reference to the accompanying drawings, in which.

PREFERRED MODE OF CARRYING OUT THE INVENTION

A first embodiment of a golf club support according to the present invention is generally depicted as 10 in FIGS. 1 to 5.

In this embodiment, the support 10 is shown as a device that can be fitted to the rim 11 of a golf bag 12. It will, however, be appreciated that the support 10 could be formed integral with the bag 12.

Figure 2:
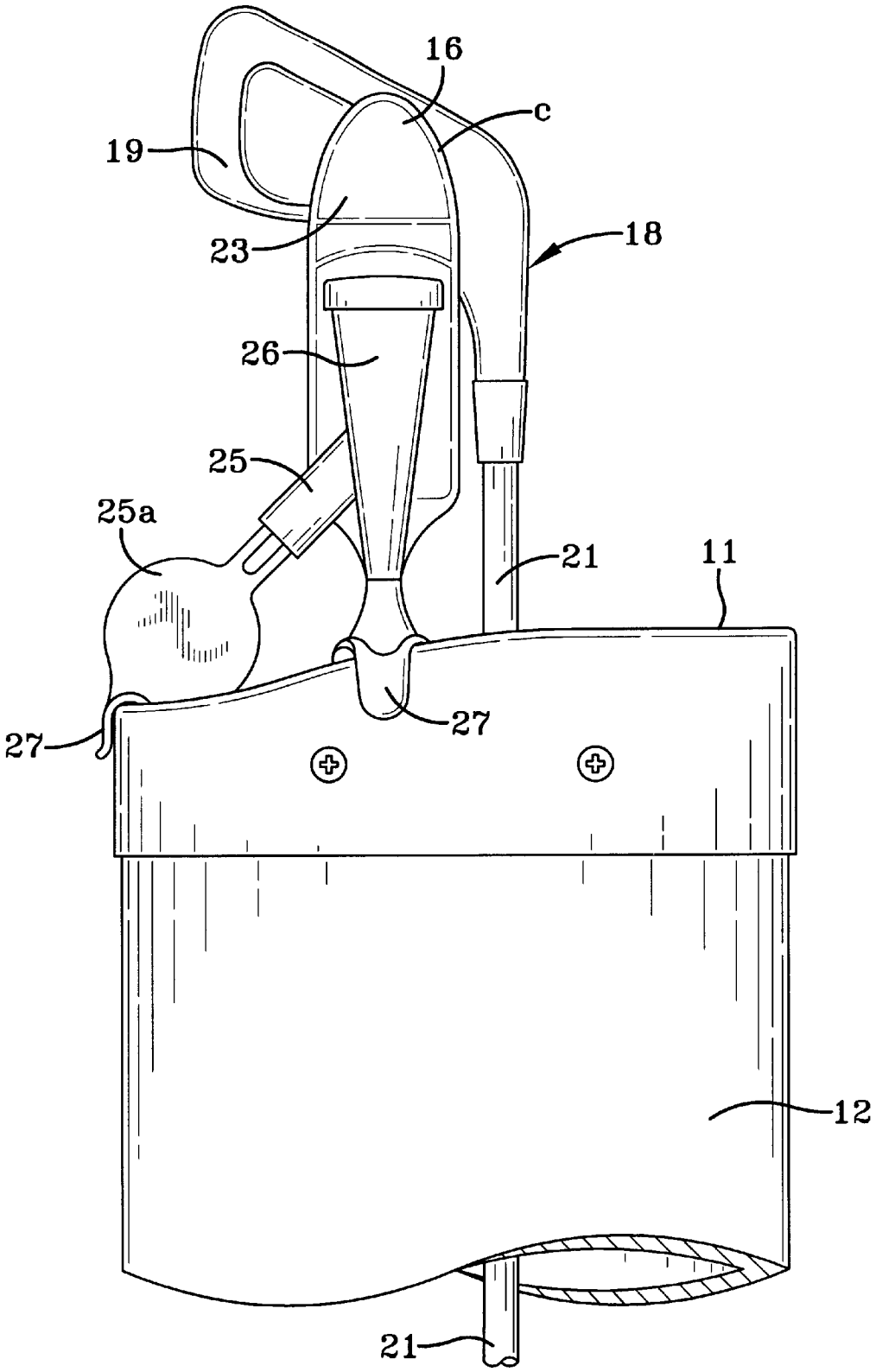
FIG. 2 is an edge elevational view of the support of FIG. 1 with one club shown supported thereby.
Figure 3:
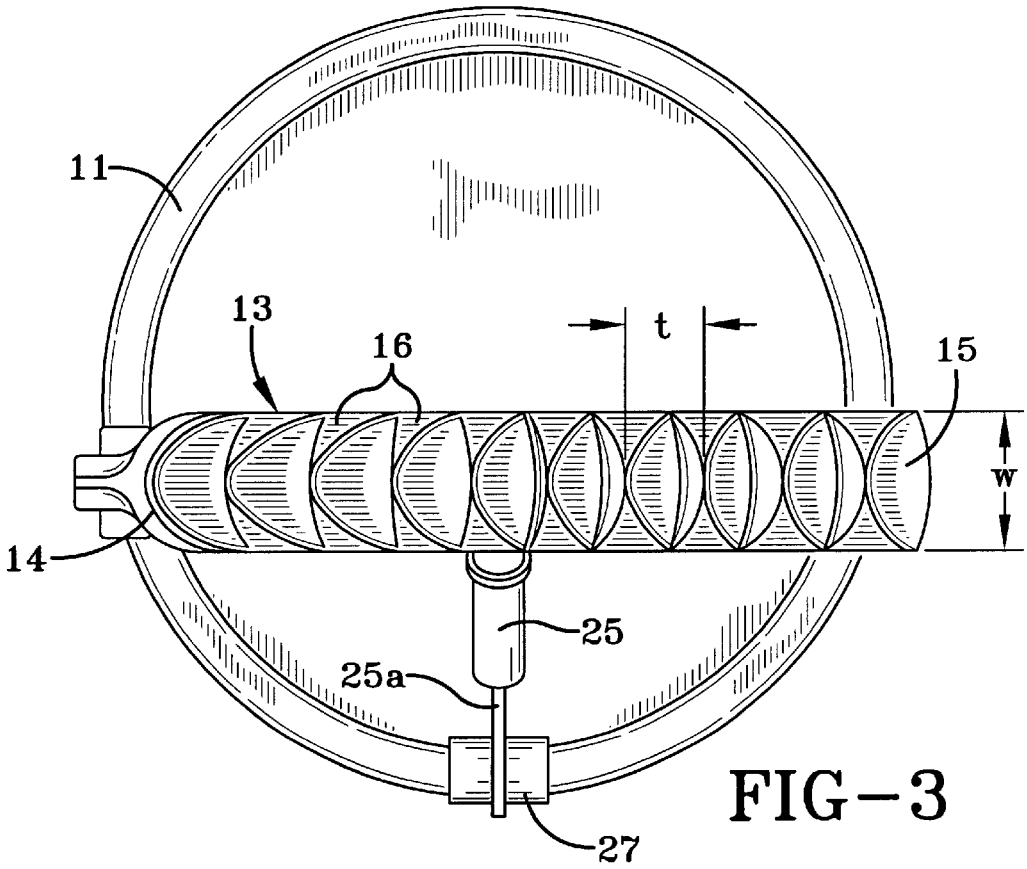
FIG. 3 is a plan view of the support of FIG. 1.

The support 10 comprises a longitudinal base 13 extending from a first end 14 to a second end 15. Extending outwardly from the upper surface of the base 13 is a plurality of dividers 16. Each pair of dividers define therebetween a space, generally shown as 17, adapted to support the head of a club, with the shaft extending downwardly into the bag 12. As depicted in FIG. 2, a golf club iron 18 comprises a head 19 and shaft 21 extending to a grip (not visible) at an end of the shaft 21 distal the head 19.

Each divider 16 in the depicted embodiment has a first concave face 22 and a second convex face 23. While the outer faces of the dividers 16 at the first and second ends (14,15) of the base 13 are depicted as having concave and convex faces, respectively, it will be understood that the outer faces of these end dividers could be a shape other than concave and convex, if desired.

The base member 13 is mounted to the rim 11 of the golf bag 12 by three legs 24,25,26. In the depicted embodiment, leg 25 is pivotable relative to the base member 13 and is so adjustable to allow easy mounting of the support 10 to the rim 11 of any bag 12. Leg 25 incorporates a shaft 25*a* slidably engagable with a slot 25*b* to allow ready adjustment of the length of the leg 25. If desired, the position of each of the legs 24,25,26 relative to the base member 12 can be adjustable to allow for any variation in the shape and dimensions of the rim 11 of the bag 12. Each of the legs 24,25,26 has a clamping member 27 that allows the support 10 to be readily attached to the rim 11 of the golf bag 12.

Figure 4:
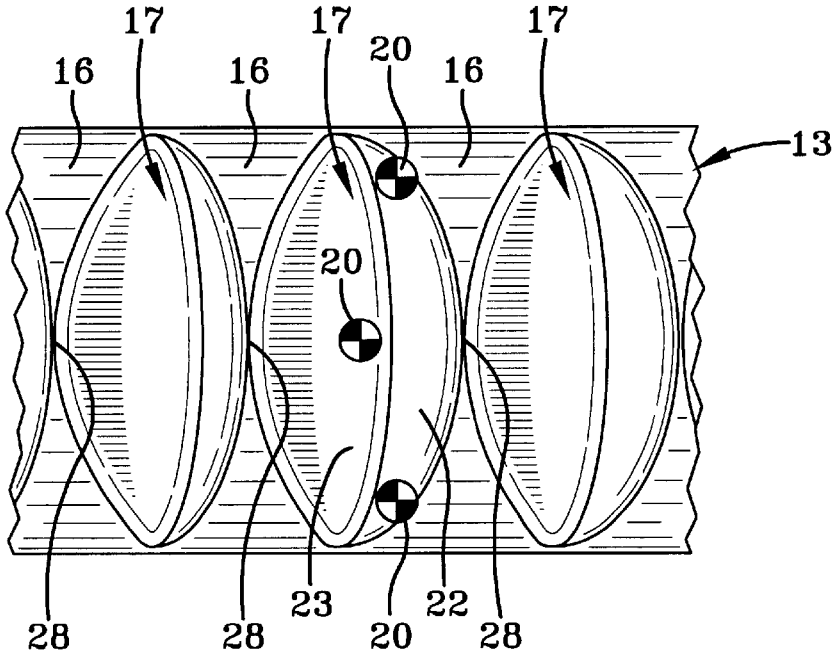
FIG. 4 is an enlarged plan view of a portion of the support of FIG. 1.
Figure 5:
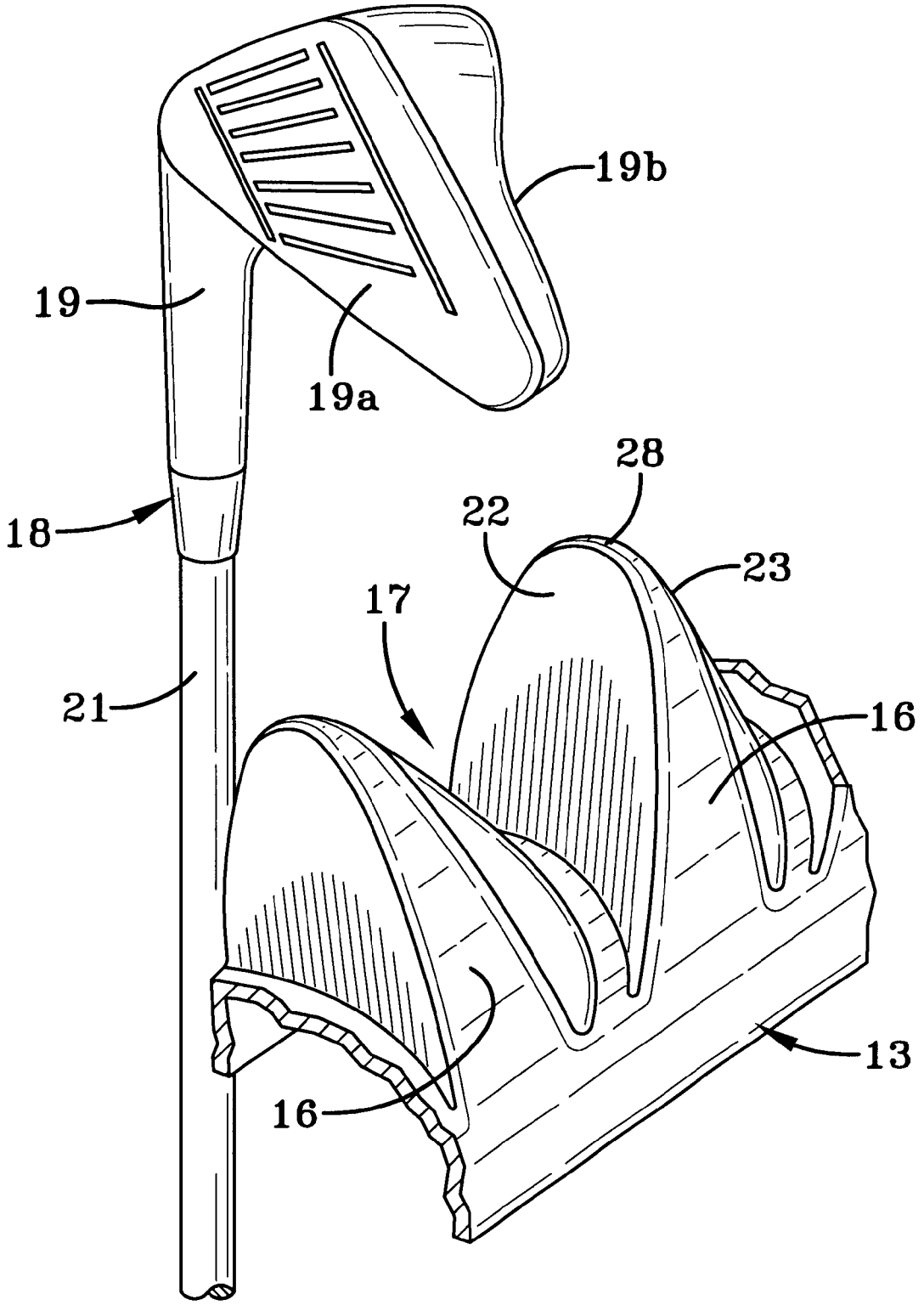
FIG. 5 is an enlarged perspective view of a portion of the support of FIG. 1.

In the depicted embodiment, the angle a of the convex face 23 of each divider 16 to the base member 13 varies from the first end 14 to the second end 15. At the first end 14, the angle of the convex face 23 to vertical is greater than the angle of the convex face 23 of the divider at the extreme second end 15, with a gradual decrease of the angle a along the array of dividers from the first end 14 to the second end 15. This graduation in angle provides the player with a clear order in which to place the set of club irons within the golf bag 12. To facilitate the player placing the correct iron in the correct space 17, each of the spaces 17 (or one of the dividers 16 defining the particular space 17) could be labelled with a number indicating the club iron that should be placed in that space 17. The angle of the convex face 23 of each of the dividers 16 is slightly less than the loft angle of the club that would be expected to be stored in the space adjacent the convex face 23. This results in the player having to exert a relatively slight force to push the club head 19 into its designated space 17. As the head 19 is pushed into place, the dividers 16 each side of the relevant space flex slightly to accommodate the head 19. The combination of the spacing of the dividers 16, the angle a of the convex faces 23, and the flex of the dividers serves to grip the club head 19 in the support 10. As depicted in FIG. 4, the club head is effectively gripped at least three locations 20 by the dividers 16. The first location 20 is near the center of the convex face 23 which comes into contact with the front ball-striking surface 19*a* of the club head 19. The second and third locations 20 are adjacent the edges of the concave face 22 of the adjacent divider 16 which frictionally engage with the back surface 19*b* of the club head 19.

Figure 1:
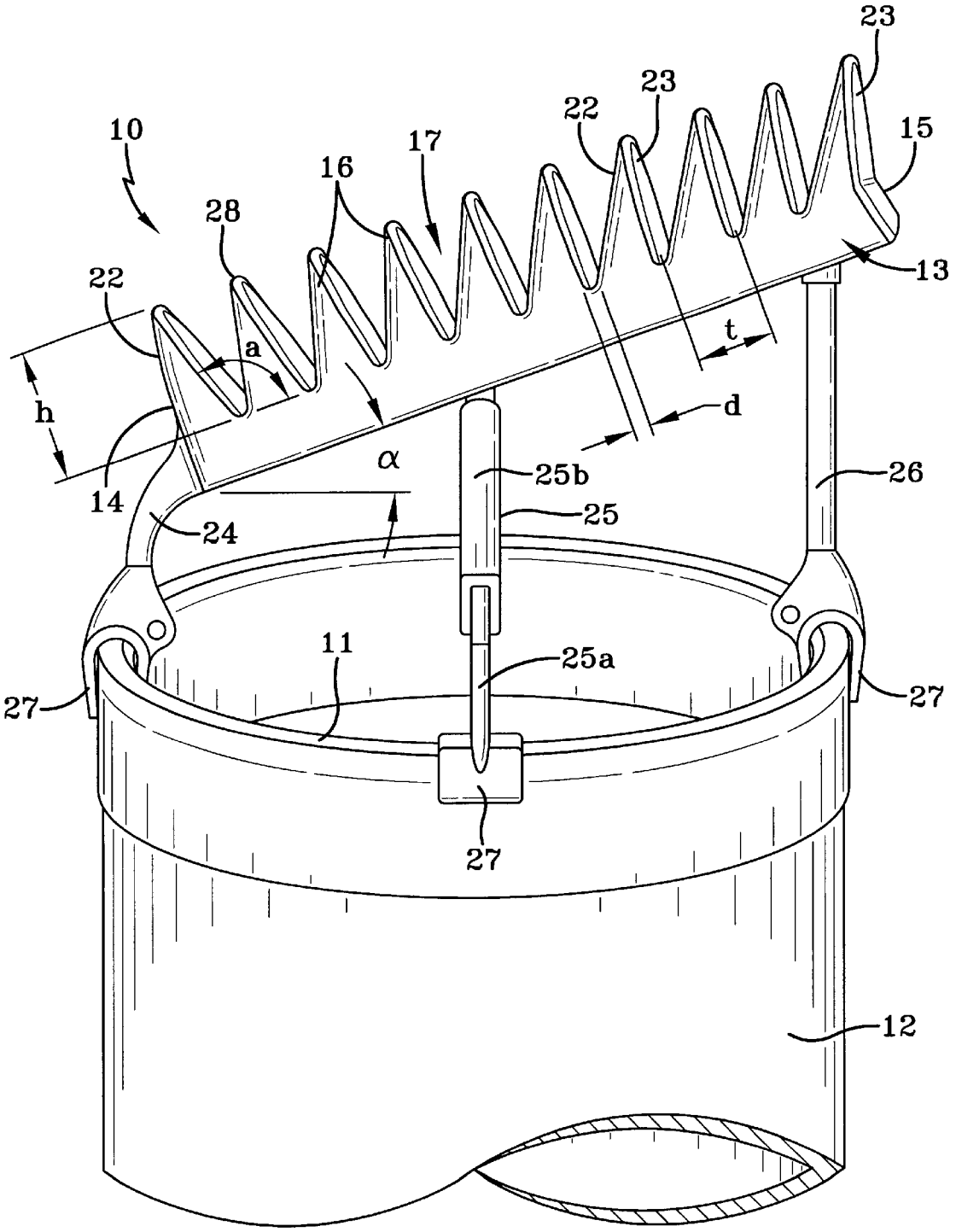
FIG. 1 is a perspective view of one embodiment of the golf club support according to the present invention attached to the rim of a mouth of a golf bag.

It will be appreciated from FIG. 1 that the base member 13 is aligned at an angle $\alpha$ to a notional plane normal to the mouth of the golf bag 12. For the purposes of clarity, the notional plane will typically be normal to true vertical. The space 17 for a higher number iron is positioned at the first end 14 of the support 10 and is closer to the mouth of the bag 12 than the space for the lowest number iron at the second end 15. As it is well understood in golf that the shaft 21 of the lower numbered irons are longer than the higher numbered clubs, the angle $\alpha$ of the support 10 serves to ensure that all of the clubs can be supported by the support 10 while serving to minimize the distance that the clubs extend beyond the mouth of the bag 12.

The dimensions of each divider 16 decrease in both width w and thickness t from the end integral with the base member 13 to the end 28 distal the base 13. The height h of each divider 16 from the base member 13 to the distal end 28 is about 45 mm in the depicted embodiment. The width w of each divider 16 where it joins the base 13 is about 50 mm. The distance d between each of the dividers 16 where the dividers join the base 13 is constant and is about 2 mm. Further, as mentioned above, if a divider 16 is viewed in end elevation view, the divider 16 decreases in width w towards the distal end 28 with the sides c of the divider being preferably continuously curved, and the curvature may be substantially parabolic. In the depicted embodiment, the support, including the dividers 16, is formed from a molded elastomeric material, while the legs 24,25,26 are formed from a molded thermoplastics material.

In use, the support 10 will normally be kept mounted to the rim 11 of the bag 12. The player will place the set of club irons in sequence in the support 10 where they are kept except when a particular club is withdrawn from the bag 12 to be used in play. The sequencing of the club heads in the support 10 serves to provide a neat and orderly mounting of the clubs in the bag 12. This not only facilitates easy identification of the club in the bag 12 but also serves to lessen the clash of the club heads and shafts in the bag 12 and so lessens the likelihood of damage to both.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A device for supporting golf clubs, where each club comprises a shaft and a head, the device comprising a base member and a plurality of dividers extending outwardly from the base member, said dividers being longitudinally aligned so as to form a rack for supporting the club heads, and at least one divider having a concave face and an adjacent divider having a generally oppositely facing convex face, the dividers being positioned so as to define therebetween a space for receiving a club head.

2. The device for supporting golf clubs of claim 1 wherein each of the dividers has a first concave face and a generally opposite facing second convex face, such that the space defined between each pair of dividers of the device is defined in part by a concave face and a convex face.

3. The device for supporting golf clubs of claim 2 wherein the base member has tendividers defining in total nine club head spaces.

4. The device for supporting golf clubs of claim 1 wherein the base member has at least two leg members, with one leg member extending in a direction generally opposite to that of the outwardly extending dividers from a position at or adjacent a first end of the base member to a distal end, and a second leg member extending in a direction generally opposite to that of the outwardly extending dividers from a position at or adjacent a second end of the base member to a distal end.

5. The device for supporting golf clubs of claim 4 wherein at or adjacent the distal ends of the leg members, the leg members have attaching means such that the leg members can be attached to a rim of a mouth of a tubular golf bag.

6. The device for supporting golf clubs of claim 5 wherein the attaching means for each leg comprises a clamp or pincer.

7. The device for supporting golf clubs of claim 5 wherein the leg member at or adjacent the first end of the base member is shorter than the leg member at or adjacent the second end of the base member such that, when mounted over a mouth of a tubular golf bag, the base member is disposed at an angle to a notional plane normal to the longitudinal axis of the golf bag.

8. The device for supporting golf clubs of claim 7 wherein a third leg also extends from the base member in a direction generally opposite to that of the outwardly extending dividers.

9. The device for supporting golf clubs of claim 8 wherein the third leg is positioned about midway along the base member between the first and second legs.

10. The device for supporting golf clubs of claim 9 wherein the third leg has an attaching means distal the base member to allow attachment of the leg to the rim of the mouth of a golf bag.

11. The device for supporting golf clubs of claim 7 wherein, when the device is mounted to the mouth of a golf bag, the base member is at an angle of between about 10 and 40 degrees to the notional plane normal to the longitudinal axis of the bag.

12. The device for supporting golf clubs of claim 11 wherein the angle is between about 20 and 30 degrees to the notional plane normal to the longitudinal axis of the bag.

13. The device for supporting golf clubs of claim 12 wherein the angle is about 25 degrees to the notional plane normal to the longitudinal axis of the bag.

14. The device for supporting golf clubs of claim 13 wherein the angle between a notional plane in planar alignment with the convex face of a divider and true vertical, when the device is mounted to the mouth of a bag at an angle of about 25 degrees to the notional plane normal to the longitudinal axis of the bag, varies for each divider from the first end to the second end of the device.

15. The device for supporting golf clubs of claim 14 wherein the angle between the notional plane in planar alignment with the convex face of a divider and true vertical decreases for each divider from the first end to the second end of the device.

16. The device for supporting golf clubs of claim 15 wherein, where the device has 10 dividers, said angle to true vertical of the first to tenth convex faces, the first convex face being near the first end of the device and the tenth convex face being near the second end of the device, is as set in the following table:

| Convex Face | Angle (degrees) |
|---|---|
| First | 16 |
| Second | 18 |
| Third | 21 |
| Fourth | 24 |
| Fifth | 28 |
| Sixth | 32 |
| Seventh | 36 |
| Eighth | 40 |
| Ninth | 44 |
| Tenth | 48. |

17. The device for supporting golf clubs of claim 2 wherein each divider is formed integrally with the base member.

18. The device for supporting golf clubs of claim 2 wherein both the width and thickness of each divider decreases away from the base member to an end distal the base member.

19. The device for supporting golf clubs of claim 18 wherein, if each divider is viewed in end elevational view, the divider decreases in width towards its distal end with the sides of the divider being preferably continuously curved.

20. The device for supporting golf clubs of claim 19 wherein the curvature is substantially parabolic.

21. The device for supporting golf clubs of claim 18 wherein, if each divider is viewed in side elevational view, the divider decreases in thickness towards its distal end, with the decrease being smoothly tapering from the base member to the distal end.

22. The device for supporting golf clubs of claim 2 wherein the distance of separation between each pair of dividers on the base member, measured where the dividers meet the base member, is substantially identical.

23. The device for supporting golf clubs of claim 2 wherein each divider is moulded from a resiliently flexible polymeric or elastomeric material.

24. A device for supporting golf clubs, where each club comprises a shaft and a head having a front and rear face, the device comprising a base member, a plurality of dividers extending outwardly from the base member, each of the base members having a first face and a second generally oppositely facing second face, the dividers being positioned so as to define therebetween a space for receiving a club head, the first face being adapted to engage the rear face of the club at two locations and the second face being adapted to engage the front face of the club at one location.

25. The device for supporting golf clubs of claim 24 wherein the first face of at least one of the dividers is a concave face.

26. The device for supporting golf clubs of claim 25 wherein the first face of each of the dividers is a concave face.

27. The device for supporting golf clubs of claim 24 wherein the second face of at least one of the dividers is a convex face.

28. The device for supporting golf clubs of claim 25 wherein the second face of at least one of the dividers is a convex face.

29. The device for supporting golf clubs of claim 28 wherein the second face of each of the dividers is a convex face.

30. The device for supporting golf clubs of claim 29 wherein the second face of each of the dividers is a convex face.

31. A device for supporting golf clubs, where each club comprises a shaft and a head, the device comprising:

a base member; and a plurality of dividers extending outwardly from the base member, at least one divider having a concave face and an adjacent divider having a generally oppositely facing convex face, the dividers being positioned so as to define therebetween a space for receiving a club head;

wherein both the width and thickness of said at least one divider decreases away from the base member to an end distal the base member.

* * * * *